US006544108B2

(12) United States Patent
McCoy

(10) Patent No.: US 6,544,108 B2
(45) Date of Patent: Apr. 8, 2003

(54) APPARATUS FOR IN-LINE SURFACE POLISHING OF CYLINDRICAL STOCK SUCH AS STAINLESS STEEL TUBING, AND METHOD

(76) Inventor: Thomas E. McCoy, 467 Robinson Rd., Mooresville, NC (US) 28117-9098

( * ) Notice: Subject to any disclaimer, the term of this patent is extended or adjusted under 35 U.S.C. 154(b) by 0 days.

(21) Appl. No.: 09/960,674

(22) Filed: Sep. 21, 2001

(65) Prior Publication Data

US 2003/0022602 A1 Jan. 30, 2003

Related U.S. Application Data

(60) Provisional application No. 60/308,083, filed on Jul. 26, 2001.

(51) Int. Cl.[7] ..... B24B 1/00

(52) U.S. Cl. ..... 451/49; 451/300; 451/59; 451/66; 451/301; 451/307

(58) Field of Search ..... 451/51, 59, 300, 451/301, 307, 907, 49, 65, 66

(56) References Cited

U.S. PATENT DOCUMENTS 2,896,378 A * 7/1959 Ketaing
3,760,537 A * 9/1973 Bovati
3,803,776 A * 4/1974 Shaffer et al.
5,658,187 A 8/1997 McCoy
5,759,089 A 6/1998 McCoy

OTHER PUBLICATIONS

Stephen Bader Co., Inc., catalog for Standard and Special Machinery and Accessories; Jul. 12, 1999, six(6) pages; USA.

Stephen Bader Co., Inc., Price List; Jul. 12, 1999; four (4) pages; USA.

* cited by examiner

*Primary Examiner*—Eileen P. Morgan
(74) *Attorney, Agent, or Firm*—Adams, Schwartz & Evans, P.A.

(57) ABSTRACT

A surface finishing apparatus for in-line outer surface polishing of elongate cylindrical metal stock to apply a long scratch finish, including a stock feeder for feeding a length of stock through the finishing apparatus from an infeed downstream to an outfeed position while rotating the stock about its longitudinal axis and a polishing assembly for finish-treating the outer surface of the stock as the stock is fed through the apparatus to apply a long scratch finish thereto. The polishing assembly includes a rotatable finishing wheel having a finish-treating peripheral surface for being applied in an in-line orientation against the outer surface of the stock as the stock is simultaneously fed and rotated through the finishing apparatus. The finishing wheel is mounted on an axis of rotation which is perpendicular to the longitudinal axis of the stock, and is rotated at a speed sufficiently great in comparison to the speed of rotation of the stock that the scratch finish applied to the stock is linear and extends substantially along the longitudinal axis of the stock.

22 Claims, 5 Drawing Sheets

APPARATUS FOR IN-LINE SURFACE POLISHING OF CYLINDRICAL STOCK SUCH AS STAINLESS STEEL TUBING, AND METHOD

This application is based on and claims priority from Provisional Patent Application Ser. No. 60/308,083, filed on Jul. 26, 2001.

TECHNICAL FIELD AND BACKGROUND OF THE INVENTION

This invention relates to an apparatus for in-line surface finishing elongate cylindrical stock, for example, stainless steel tubing, and a method for in-line surface finishing of cylindrical stock such as stainless steel tubing. Use of the term "in-line" is used in this application to mean that the scratch pattern of the surface finish applied to the stock extends substantially parallel to, or linearly along, the longitudinal axis of the stock. Applicant's prior patent, U.S. Pat. No. 5,759,089, for example, discloses an apparatus and method for buffing the surface of stainless steel tubing to achieve a chrome-bright finish. The scratch pattern extends generally along the length of the tubing. However, the buffing process described in the above-referenced patent ramdomizes the scratch pattern by randomly-oscillating the buffing wheels across the surface of the tubing while reducing the scratches to the point where they are essentially invisible to the naked eye. Tubing finished in this manner has numerous mechanical and ornamental applications, including railing and ladders for boats, exterior vehicle accessories, and metal furniture structural pieces such as legs and arms.

However, other applications require a "brushed" look. For example, many commercial and residential appliances such as stoves, refrigerators now have a brushed steel finish. Such unpainted brushed finishes have recently become more popular as more expensive residential appliances are designed to resemble commercial cooking equipment. However, certain parts such as handles cannot presently be machine-processed to impart a brushed finish which will match the brushed finish on the doors, sides top and other visible surfaces. Thus, it is presently necessary for matching handles and the like to be hand finished. This is done manually by pressing the object against a polishing wheel covered with polishing paper with a grit which applies a long scratch along the longitudinal axis of the object.

This prior art practice presents several disadvantages, including the expense of carrying out this process manually instead of automatically and the variability of quality and appearance resulting from variation in the skill of the person carrying out the process.

The apparatus and process described comes near the end of a number of other prior art processes, the major ones being described briefly below.

In general, coiled stainless steel sheet between 18 inches and 60 inches wide and 5,000 feet long is slit into a strip which is as wide as the circumference of the tubing to be formed. For example, tubing having an O.D. of one inch will be slit into a strip 3.1416 inches wide. The strip is rolled back into a coil and taken to a tube mill. The tubing is formed by traversing the strip in a continuous process through a series of forming rollers. The initial stage is referred to as the "breakdown" stage, where the opposing edges are turned upwardly.

The strip is then passed to a "fin" section, where the opposing edges are gradually and progressively curved upwardly towards each other until the strip has been formed into a closed cylindrical tube with the opposing edges aligned with each other.

The tube is passed through a welding machine where the two opposing edges are continuously welded to each other. The welded tube then passes through a grinder where the weld is ground flush with the adjacent walls of the tube. The tube is then passed through a precision-sizing section where a series of precisely sized and aligned sizing rollers shape the tubing to its final size and cylindrical shape.

The tubing is then cut to a predetermined manageable length, for example, 30 feet, for further processing.

In some prior art processes, the tubing is then polished. "Polishing" is a term of art which means using progressively finer- grit sandpaper to put an initial smooth finish on the exterior surface of the tubing. The sandpaper is applied to the tubing as the tubing is rotated. Thus, a radial finish is applied to the tubing during this process. The scratch pattern formed during this process extends radially around the outer circumferential surface of the tubing and are quite easily seen when light is reflected off of the tube. In relative terms, polishing applies a finish where the scratch pattern is clearly visible and, as described above, is desirable when a brushed look is needed. However, the radial pattern applied by prior art machine polishing processes is clearly undesirable, since it does not match the long scratch pattern of brushed stainless steel used on commercial and high end residential appliances.

The apparatus and method disclosed in this application polishes stainless steel tubing "in-line" at commercial speeds to a brushed finish which exhibits a highly desirable ornamental appearance wherein the visible scratches extend generally longitudinally along the length of the stainless steel tubing to which the finish is applied.

SUMMARY OF THE INVENTION

Therefore, it is an object of the invention to provide an apparatus for in-line surface finishing elongate cylindrical stock.

It is another object of the invention to provide an apparatus for in-line or linear surface finishing stainless steel tubing.

It is another object of the invention to provide an apparatus for in-line polishing of stainless steel tubing.

It is another object of the invention to provide an apparatus for polishing stainless steel tubing without applying a radial scratch pattern to the outer surface of the tubing.

It is another object of the invention to provide an apparatus for polishing stainless steel tubing which operates a speeds compatible with other commercial stainless steel tubing manufacturing steps.

It is another object of the invention to provide a method for in-line surface finishing of cylindrical stock such as stainless steel tubing which achieves a brushed finish wherein the scratch pattern extends longitudinally along the length of the tubing and thus avoids the appearance of rings around the tubing characteristic of prior art machine polishing processes.

These and other objects of the present invention are achieved in the preferred embodiments disclosed below by providing a surface finishing apparatus for in-line outer surface polishing of elongate cylindrical metal stock to apply a long scratch finish, comprising a stock feeder for feeding a length of stock through the finishing apparatus from an infeed downstream to an outfeed position while rotating the stock about its longitudinal axis and a polishing assembly for finish-treating the outer surface of the stock as the stock is fed through the apparatus to apply a long scratch finish thereto. The polishing assembly comprises a rotatable finishing wheel having a finish-treating peripheral surface for being applied in an in-line orientation against the outer surface of the stock as the stock is simultaneously fed and rotated through the finishing apparatus. The finishing wheel is mounted on an axis of rotation which is perpendicular to the longitudinal axis of the stock, and is rotated at a speed sufficiently great in comparison to the speed of rotation of the stock that the scratch finish applied to the stock is linear and extends substantially along the longitudinal axis of the stock.

According to one preferred embodiment of the invention, the apparatus includes second and third rotatable finishing wheels positioned downstream of the finishing wheel for altering the finish applied by the finishing wheel.

According to another preferred embodiment of the invention, a stock-engaging backup support is positioned for engagement with the rotating stock against the direction of rotation of the stock for preventing lateral displacement of the stock by the stock rotating wheel.

According to yet another preferred embodiment of the invention, each of the finishing wheels is vertically positioned above the stock for being applied against an upper surface of the rotating stock.

According to yet another preferred embodiment of the invention, an adjustment apparatus is provided for adjusting the vertical position of the finishing wheel relative to the stock.

According to yet another preferred embodiment of the invention, the stock rotating wheel comprises a drive roller mounted between the infeed position and the outfeed position on an axis in non-parallel alignment with the longitudinal axis of travel of the stock for rotation in a direction having a component diagonal to the direction of travel of the stock through the finishing apparatus for simultaneously rotating and feeding the stock downstream to the outfeed position, the driver roller positioned to support the stock and rotate the stock by surface-to-surface driving contact between the outer surface of the stock and an outer, driving surface of the drive roller.

According to yet another preferred embodiment of the invention, a plurality of pairs of guide rollers is positioned along the length of the finishing apparatus between the infeed position and the outfeed position for positioning and maintaining the stock therebetween and in finishing position in relation to the finishing wheels.

According to yet another preferred embodiment of the invention, the finishing wheel supports on its contact surface with the stock a belt having a finishing surface thereon, the belt carried for rotation on the finishing wheel and at least one supporting idler wheel.

According to yet another preferred embodiment of the invention, the finish-treating peripheral surface of the finishing wheel is selected from a group of finish treating materials consisting of sisal, and a synthetic polishing material.

According to yet another preferred embodiment of the invention, the finishing wheel applies an initial cut finish to the stock, the second finishing wheel applies a finish cut to the stock and the third finishing wheel applies a blending finish to the stock.

According to yet another preferred embodiment of the invention, a tension adjustment apparatus is provided for adjusting the tension of the belt against the finishing wheel.

An embodiment of the method of in-line outer surface polishing of elongate cylindrical metal stock to apply a long scratch finish according to the invention comprises the steps of feeding a length of stock from an infeed downstream to an outfeed position while rotating the stock about its longitudinal axis;

According to yet another preferred embodiment of the invention, a finish treatment is applied to the outer surface of the stock as the stock is fed, the finish-treating step being applied in an in-line orientation against the outer surface of the stock as the stock is simultaneously fed and rotated on an axis of rotation which is perpendicular to the longitudinal axis of the stock wherein the finish-treating step as applied at a speed sufficiently great in comparison to the speed of rotation of the stock that the scratch finish applied to the stock is linear and extends substantially along the longitudinal axis of the stock.

According to yet another preferred embodiment of the invention, the method includes the steps of applying second and third finish treatments to the stock downstream of the finish treatment for altering the finish applied to the stock.

According to yet another preferred embodiment of the invention, the method includes the step of engaging the rotating stock against the direction of rotation of the stock for preventing lateral displacement of the stock as it rotates.

According to yet another preferred embodiment of the invention, the method includes the step of applying the finishing treatments with wheels having respective finish-applying surfaces vertically positioned above the stock for being applied against an upper surface of the rotating stock.

According to yet another preferred embodiment of the invention, the method includes the step of adjusting the vertical position of the finishing wheel relative to the stock for varying the pressure at which the finish is applied to the stock.

According to yet another preferred embodiment of the invention, the step of rotating the stock includes the step of engaging the stock at an axis in non-parallel alignment with the longitudinal axis of travel of the stock for rotation in a direction having a component diagonal to the direction of travel of the stock for simultaneously rotating and feeding the stock downstream to the outfeed position.

According to yet another preferred embodiment of the invention, the method includes the step of supporting the stock on a plurality of pairs of guide rollers positioned between the infeed position and the outfeed position as it is fed and rotated.

According to yet another preferred embodiment of the invention, the step of applying the finish treatment comprises the step of supporting an endless belt having a finish treatment-applying surface thereon on a rotating finish wheel which engages the stock.

According to yet another preferred embodiment of the invention, the method includes the step of supporting the belt on a pair of idler rollers positioned upstream and downstream, respectively, of the rotating finish wheel, the idler rollers being positioned to the area of contact between the belt and the stock to increase the length of the scratch finish applied to the stock.

According to yet another preferred embodiment of the invention, the method includes the steps of the finishing wheel applying an initial cut finish to the stock, the second finishing wheel applying a finish cut to the stock and the third finishing wheel applying a blending finish to the stock.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
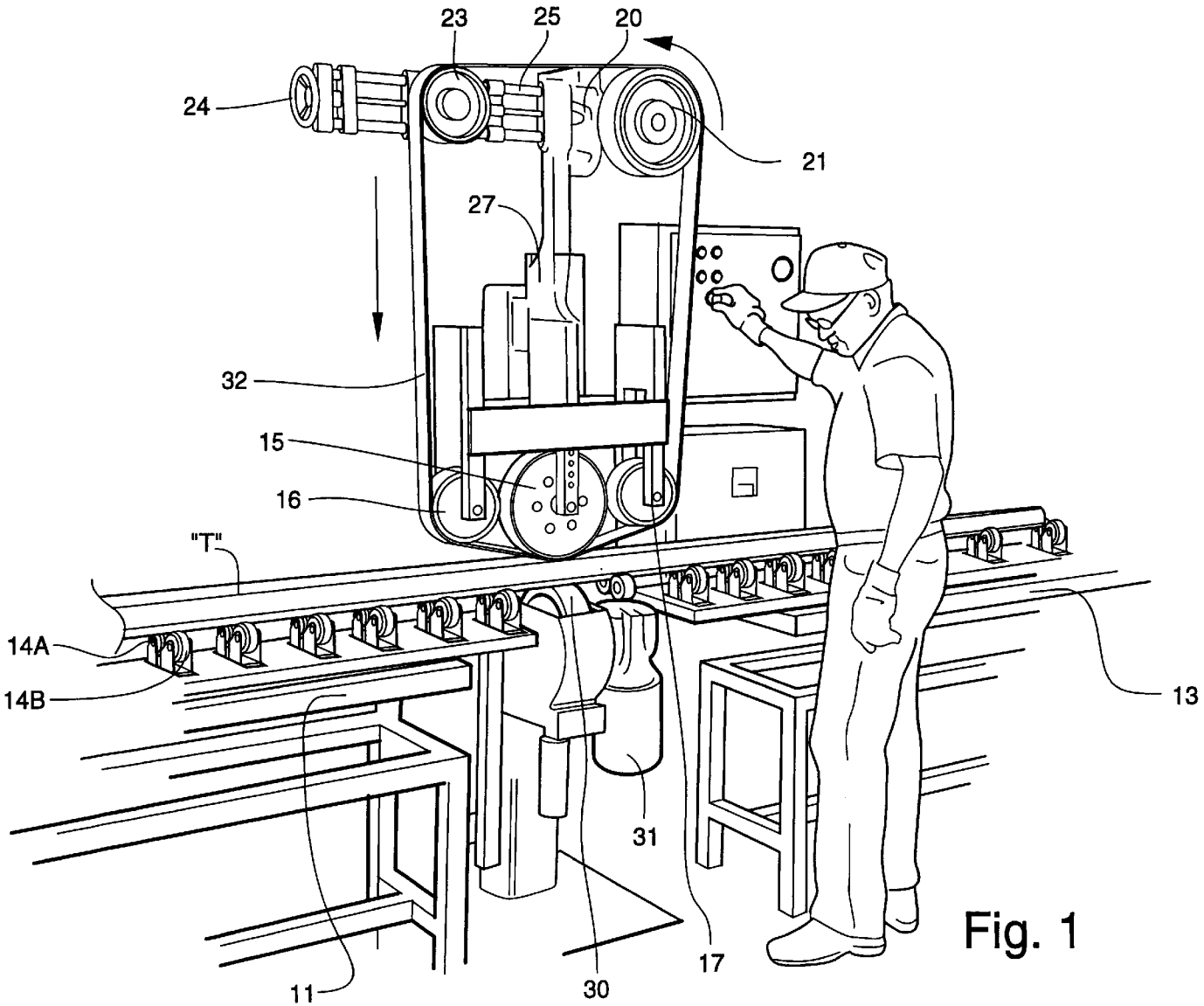
FIG. 1 is a perspective view of an apparatus for processing stainless steel tubing which includes the polishing process according to the present invention.

Referring now to FIG. 1, a polishing apparatus 10 according to one embodiment is shown. Tubing "T" is fed along an infeed table 11 to a polishing assembly 12 where the tubing is polished as described below. The tubing then passes downstream along an outfeed table 13 and to downstream processes. The tubing "T" is supported by numerous paired support rolls 14A, 14B which extend along the length of the infeed table 11 and outfeed table 13 at an offset of 4 degrees relative to the perpendicular to the infeed axis of the tubing "T". The infeed table 11 and outfeed table 13 are vertically adjustable to accommodate tubing of differing diameters and for fine adjustment.

Figure 3:
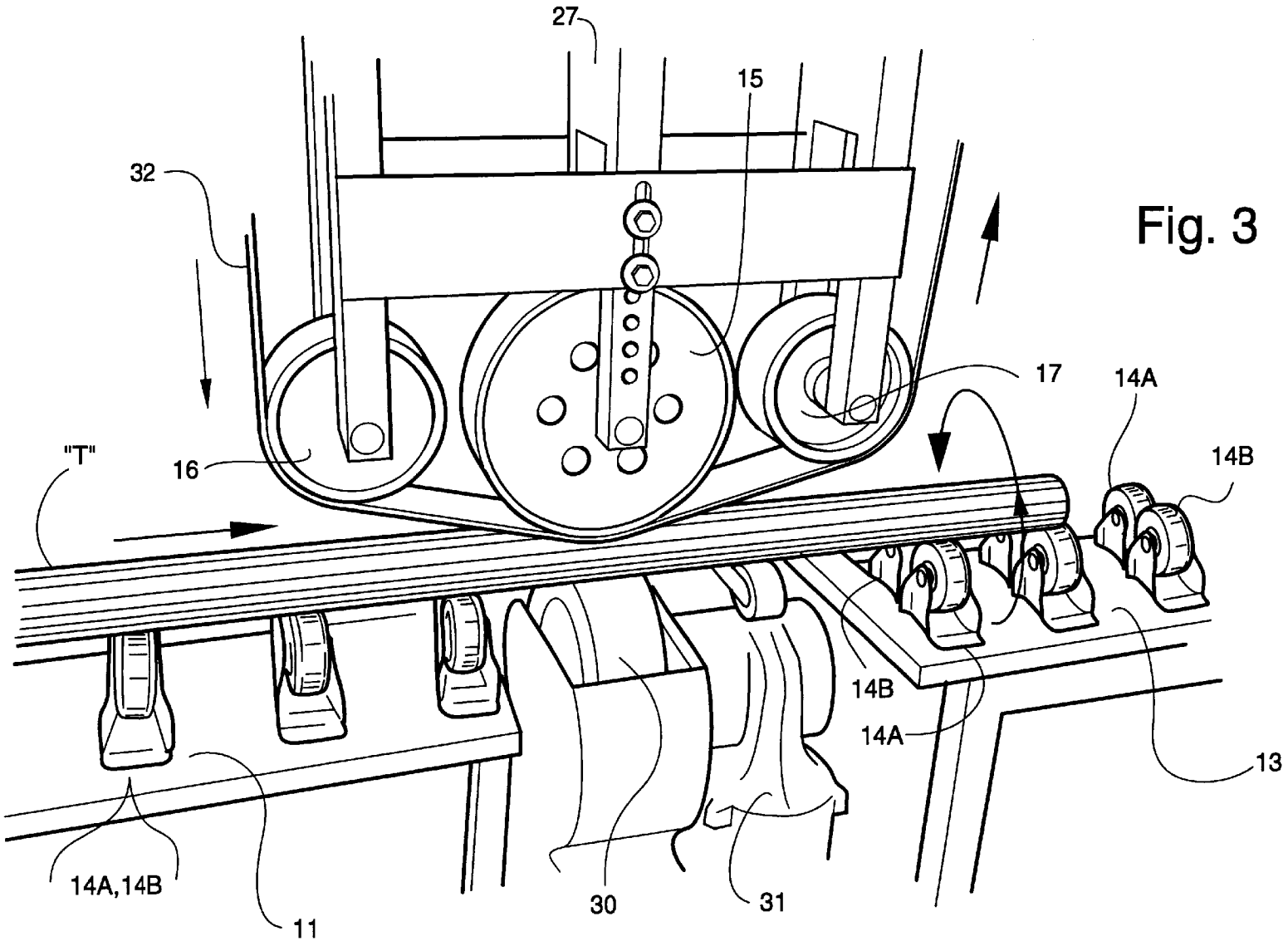
FIG. 3 is an enlarged view of the polishing wheel area of the polishing apparatus.
Figure 4:
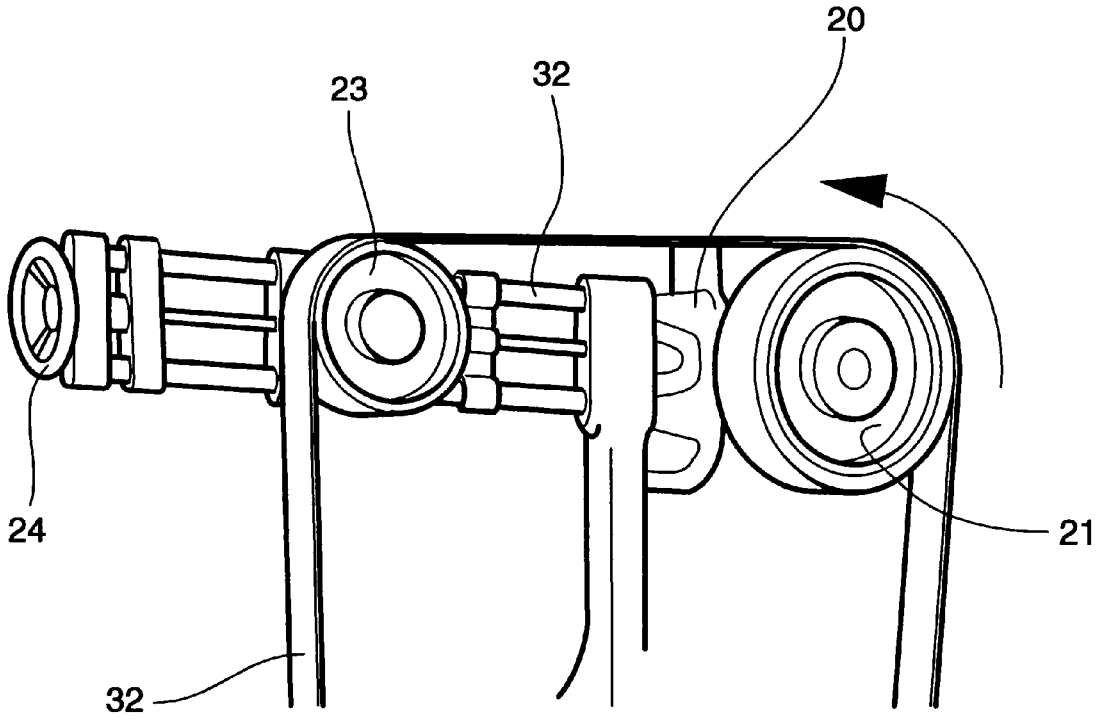
FIG. 4 is a view of the drive motor pulley and adjustable tension pulley of the polishing apparatus.
Figure 5:
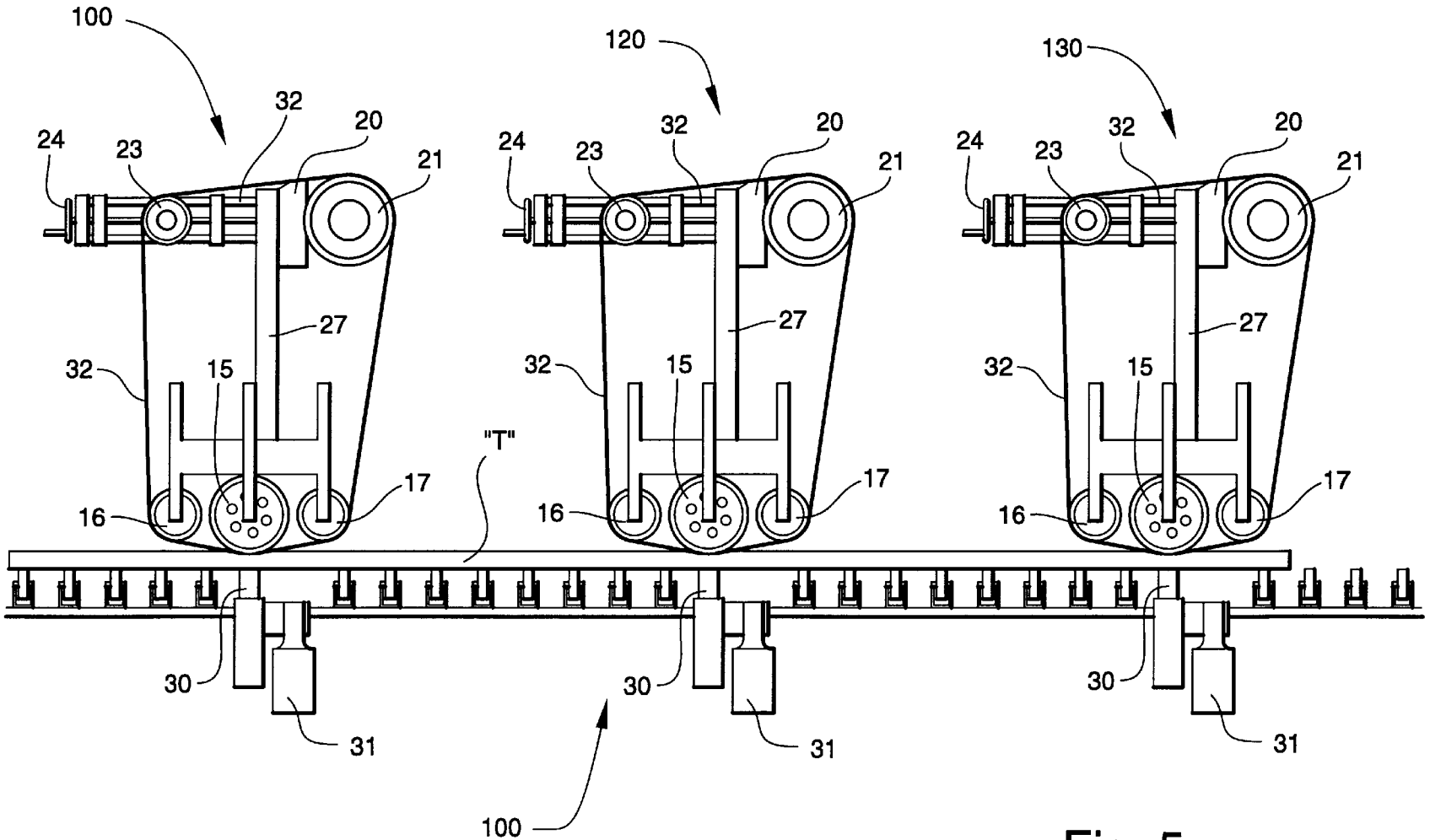
FIG. 5 is a simplified front elevation of an embodiment of a polishing apparatus wherein three sequential polishing steps are carried out in a single pass of the tubing through the apparatus.

The polishing assembly includes a polishing wheel 15 and two adjacent idler wheels 16 and 17. Tension is adjusted by a tension adjustment apparatus which includes a tension pulley 23 controlled by a tension adjustment wheel 24. The tension pulley 23 is mounted on tension adjustment bars 25 by which the distance between the drive wheel 21 and tension pulley 23 is varied. See FIG. 4. As is shown in FIGS. 1, 3 and 5, the idler wheels 16 and 17 elongate the area of contact between the tubing "T" and the polishing belt, as described below.

The polishing wheel 15, idler wheels 16, 17, drive wheel 21 and tension pulley 23 are mounted on a frame 27 above a rubber regulating wheel 30 which is driven by a variable speed drive motor 31 which rotates the regulating wheel 30 at a 4 degree angle relative to the perpendicular to the infeed axis of the tubing "T". The rotation of the offset regulating wheel 30 both rotates the tubing "T" and feeds it through the polishing apparatus 10. See FIG. 3.

Polishing is accomplished by an endless belt 32 which extends around the polishing wheel 15, idler wheels 16, 17, drive wheel 21 and tension pulley 23. The belt 32 is driven in a counterclockwise direction, i.e., in the same direction as the movement of the tubing "T." Power to move the belt 32 is supplied by a five hp variable speed motor 20 driving a rubber-covered belt drive wheel 21.

Figure 2:
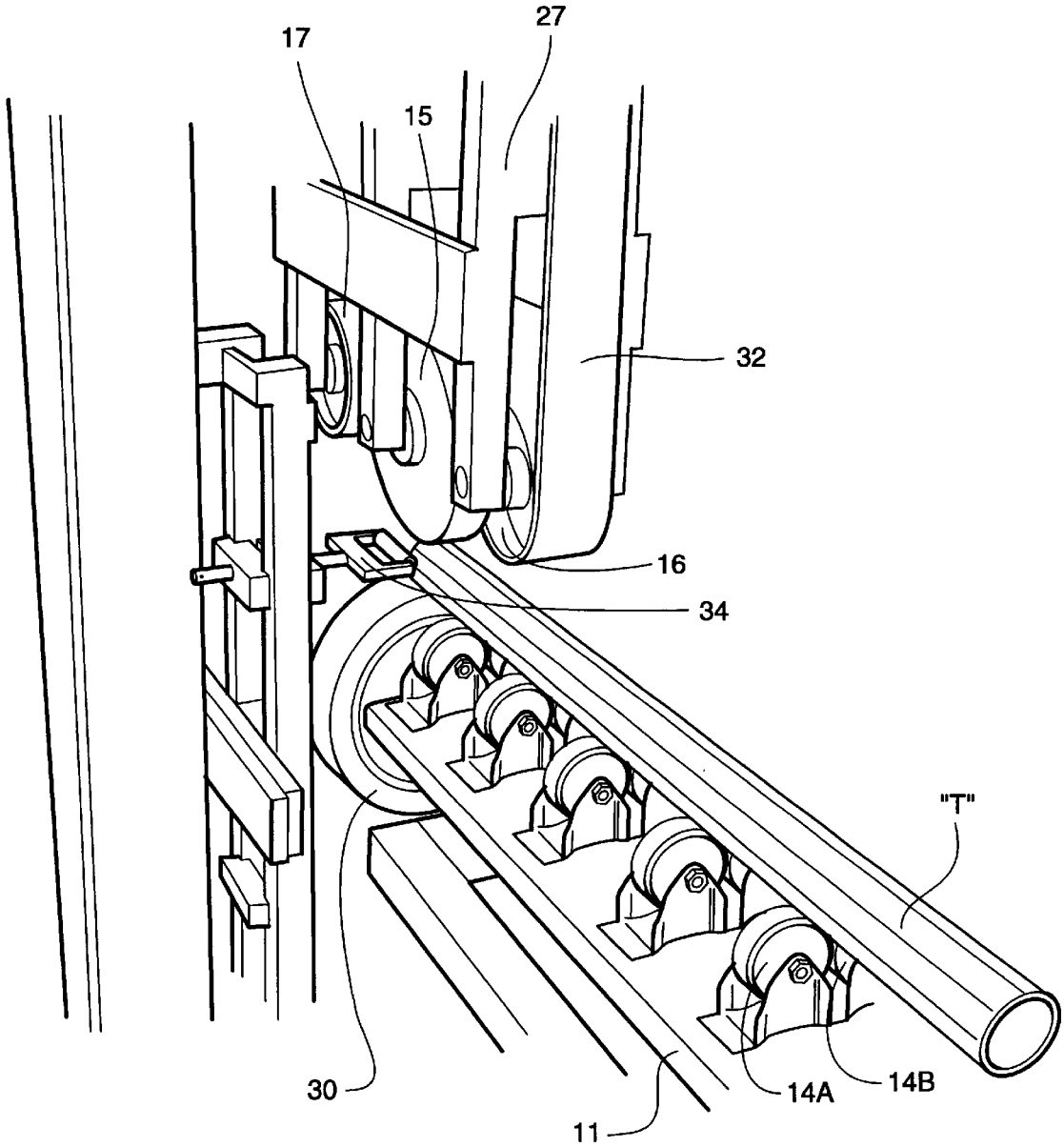
FIG. 2 is a fragmentary view of the rear of the apparatus according to an embodiment of the invention.

As is shown in FIG. 2, a back-up wheel 34 engages the back side of the tubing "T" in line with the polishing wheel 15 and stabilizes the tubing "T" as it passes through the polishing assembly 12.

The polishing wheel 15 is 2 inches wide and is formed of four 16 inch sisal polishing wheels cut down to a 12 inch diameter and held in place to expose a radially-extending perimeter of approximately ¼ inch of sisal. The outer two sisal wheels are preferably hard 8-ply model TR-6151 manufactured by Schaffner Manufacturing Company, Pittsburgh, Pa. The inner two sisal wheels are preferably soft 12-ply 15-section sisal wheels manufactured by Schaffner Manufacturing Company, Pittsburgh, Pa. It should be noted that the polishing wheel 15 itself does not contact the tubing "T" at any time. The sisal surface of the polishing wheel 15 provides a controlled amount of "give" which permits the belt 32 to assume a slightly concave shape mated to the surface of the tubing "T" passing beneath as well as increasing friction between the polishing wheel 15 and belt 32 to prevent lateral movement of the belt 32.

It has been very surprisingly found that a very uniform long scratch pattern generally extending along the longitudinal axis of the tubing "T" can be obtained even as the tubing "T" is rotated through the polishing assembly 12. Based on prior art processes, a circular scratch pattern would be expected. The longitudinal scratch pattern is accomplished by controlling the speed of rotation of the tubing "T", the speed of travel of the tubing "T" through the polishing assembly 12 and the speed of travel of the belt 32.

According to an illustrative example, a 1⅛ inch stainless steel tubing "T" is polished to a long scratch brushed finish by feeding the tubing "T" at 10 ft/min while rotating the regulator wheel 30 at 10 rpm. The polishing wheel 15 is rotated at 800 rpm, resulting in a surface speed of the belt of approximately 2,500 ft/min. The relatively rapid movement of the belt 32 along the axis of rotation of the tubing "T" combined with the relatively slow rate of rotation of the tubing "T" results in the desired pattern. In general, the scratches tend to be between 1 and 6 inches in length.

The number of passes of the tubing "T" through the apparatus 10 depends on the type, quality and uniformity of the finish desired. In one example, three passes of the tubing "T", a cutting pass, finish pass and blending pass, results in a highly uniform brushed finish. In the first pass a 180 grit belt is used. In the second pass a 180 or a 240 grit belt is used. The blending pass utilizes a heavy cut (red) Scotch-Brite brand belt manufactured by Minnesota Mining and Manufacturing (3M) to blend the scratch pattern applied during the first two passes.

An alternate embodiment of the polishing apparatus by which the entire process is accomplished in a single pass of the tubing "T" is shown in FIG. 5 and generally indicated at reference numeral 100. Three polishing assemblies 110, 120, 130 are positioned in series along the apparatus 100. The polishing assemblies 110, 120, 130 are essentially identical to the polishing assembly 12 described in detail above and are therefore not described further. An integrated control system (not shown) for regulating the tubing "T" feed rate of each of the three polishing assemblies 110, 120, 130 may be provided.

In one example, the cutting step is carried out on polishing assembly 110, the finish step on polishing assembly 120 and the blending step on polishing assembly 130. The tubing "T" thus enters the polishing apparatus 100 as a piece of unfinished stock and exits the polishing assembly 130 as a fully finished product ready for packaging and shipment to the customer. In other examples one or two of the assemblies 110, 120 or 130 can be removed from operation if not needed for the particular finish being imparted to the tubing "T."

A polishing apparatus and method for applying a brushed finish with a generally longitudinal scratch pattern is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A surface finishing apparatus for in-line outer surface polishing of elongate cylindrical metal stock to apply a long scratch finish, comprising:

(a) a stock feeder for feeding a length of stock through the finishing apparatus from an infeed position downstream to an outfeed position while rotating the stock about its longitudinal axis; and (b) a polishing assembly for finish-treating the outer surface of the stock as the stock is fed through the apparatus to apply a long scratch finish thereto, said polishing assembly comprising a rotatable finishing wheel having a finish-treating peripheral surface for being applied in an in-line orientation against the outer surface of the stock as the stock is simultaneously fed and rotated through the finishing apparatus, said finishing wheel being mounted on an axis of rotation which is fixed in a perpendicular orientation to the longitudinal axis of the stock, said finishing wheel rotating at a speed sufficiently great in comparison to the speed of rotation of the stock that the scratch finish applied to the stock is linear and extends substantially along the longitudinal axis of the stock.

2. A surface finishing apparatus according to claim 1, and including second and third rotatable finishing wheels positioned downstream of said finishing wheel for altering the finish applied by said finishing wheel, said second and third finishing wheels being mounted on an axis of rotation which is fixed in a perpendicular orientation to the longitudinal axis of the stock, said second and third finishing wheels rotating at a speed sufficiently great in comparison to the speed of rotation of the stock that the scratch finish applied to the stock is linear and extends substantially along the longitudinal axis of the stock.

3. A surface finishing apparatus according to claim 2, and including a stock-engaging backup support positioned for engagement with the rotating stock against the direction of rotation of the stock for preventing lateral displacement of the stock by the stock rotating wheel.

4. A surface finishing apparatus according to claim 1, wherein each of said finishing wheels is vertically positioned above the stock for being applied against an upper surface of the rotating stock.

5. A surface finishing apparatus according to claim 1, and including an adjustment apparatus for adjusting the vertical position of the finishing wheel relative to the stock.

6. A surface finishing apparatus according to claim 4, wherein said stock rotating wheel comprises a drive roller mounted between the infeed position and the outfeed position on an axis in non-parallel alignment with the longitudinal axis of travel of the stock for rotation in a direction having a component diagonal to the direction of travel of the stock through the finishing apparatus for simultaneously rotating and feeding the stock downstream to the outfeed position, said driver roller positioned to support the stock and rotate the stock by surface-to-surface driving contact between the outer surface of the stock and an outer, driving surface of the drive roller.

7. A surface finishing apparatus according to claim 4, and including a plurality of pairs of guide rollers positioned along the length of the finishing apparatus between the infeed position and the outfeed position for positioning and maintaining the stock therebetween and in finishing position in relation to the finishing wheels.

8. A surface finishing apparatus according to claim 3, wherein said finishing wheel supports on its contact surface with the stock a belt having a finishing surface thereon, said belt carried for rotation on said finishing wheel and at least one supporting idler wheel.

9. A surface finishing apparatus according to claim 3, wherein the finish-treating peripheral surface of the finishing wheel is selected from a group of finish treating materials consisting of sisal, and a synthetic polishing material.

10. A surface finishing apparatus according to claim 2, wherein the finishing wheel applies an initial cut finish to the stock, said second finishing wheel applies a finish cut to the stock and the third finishing wheel applies a blending finish to the stock.

11. A surface finishing apparatus according to claim 8, and including a tension adjustment apparatus for adjusting the tension of the belt against the finishing wheel.

12. A surface finishing apparatus according to claim 2, and including the steps of the finishing wheel applying an initial cut finish to the stock, said second finishing wheel applying a finish cut to the stock and the third finishing wheel applying a blending finish to the stock.

13. An apparatus according to claim 1, wherein said stock comprises stainless steel tubing.

14. A method of in-line outer surface polishing of elongate cylindrical metal stock to apply a long scratch finish, comprising:

(a) feeding a length of stock from an infeed downstream to an outfeed position while rotating the stock about its longitudinal axis;

(b) applying a finish treatment to the outer surface of the stock as the stock is fed to apply a long scratch finish thereto, said finish-treating step being applied in an in-line orientation against the outer surface of the stock as the stock is simultaneously fed and rotated on an axis of rotation which is fixed in a perpendicular orientation to the longitudinal axis of the stock wherein the finish-treating step is applied at a speed sufficiently great in comparison to the speed of rotation of the stock that the scratch finish applied to the stock is linear and extends substantially along the longitudinal axis of the stock.

15. A method according to claim 14, and including the steps of applying second and third finish treatments to the stock downstream of the finish treatment for altering the finish applied to the stock, said second and third finish treatments being applied in an in-line orientation against the outer surface of the stock as the stock is simultaneously fed and rotated on an axis of rotation which is fixed in a perpendicular orientation to the longitudinal axis of the stock wherein the finish-treating step is applied at a speed sufficiently great in comparison to the speed of rotation of the stock that the scratch finish applied to the stock is linear and extends substantially along the longitudinal axis of the stock.

16. A method according to claim 15, and including the step of engaging the rotating stock against the direction of rotation of the stock for preventing lateral displacement of the stock as it rotates.

17. A method according to claim 15, and including the step of applying the finishing treatments with wheels having respective finish-applying surfaces vertically positioned above the stock for being applied against an upper surface of the rotating stock.

18. A method according to claim 17, and including the step of adjusting the vertical position of the finishing wheel relative to the stock for varying the pressure at which the finish is applied to the stock.

19. A method according to claim 14, wherein the step of rotating the stock includes the step of engaging the stock at an axis in non-parallel alignment with the longitudinal axis of travel of the stock for rotation in a direction having a component diagonal to the direction of travel of the stock for simultaneously rotating and feeding the stock downstream to the outfeed position.

20. A method according to claim 14, and including the step of supporting the stock on a plurality of pairs of guide rollers positioned between the infeed position and the outfeed position as it is fed and rotated.

21. A method according to claim 14, and including the step of applying the finish treatment comprises the step of supporting an endless belt having a finish treatment-applying surface thereon on a rotating finish wheel which engages the stock.

22. A method according to claim 21, and including the step of supporting the belt on a pair of idler rollers positioned upstream and downstream, respectively, of the rotating finish wheel, said idler rollers being positioned to elongate the area of contact between the belt and the stock to increase the length of the scratch finish applied to the stock.

* * * * *